US007090518B1

(12) United States Patent
Osada et al.

(10) Patent No.: US 7,090,518 B1
(45) Date of Patent: Aug. 15, 2006

(54) ELECTRICAL CONNECTOR WITH A LOCKING MECHANISM

(75) Inventors: Tsuyoshi Osada, Farmington Hills, MI (US); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/130,498

(22) Filed: May 17, 2005

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 5,823,809 A * 10/1998 Wakata ..... 439/157
6,354,164 B1 * 3/2002 Megason et al. ..... 74/109
6,644,992 B1 * 11/2003 Maegawa ..... 439/157
6,755,674 B1 * 6/2004 Fujii et al. ..... 439/157

* cited by examiner

*Primary Examiner*—James R. Harvey
(74) *Attorney, Agent, or Firm*—Osha Liang LLP

(57) ABSTRACT

An electrical connector includes a housing and a lever supported pivotally on a pivot disposed on the housing. The lever is configured to rotate on the pivot within a range from a pre-engagement position to a final engagement position. The lever includes a recess configured to accommodate a boss disposed on a mating connector therein in accordance with rotational movement of the lever. The lever also includes a locking mechanism having a detent to engage with an engaging portion disposed on the housing at the final engagement position. Further, the housing includes a movable stopper disposed on a surface thereof. The movable stopper engages with an edge portion of the lever at the pre-engagement position. When combined with the mating connector, the movable stopper primarily interferes with the boss, and is displaced so as to release the engagement with the edge portion of the lever. Thus, the engagement with the edge portion is released, and thereby the lever freely rotates on the pivot, while the boss is being fitted into the recess.

8 Claims, 8 Drawing Sheets

ELECTRICAL CONNECTOR WITH A LOCKING MECHANISM

BACKGROUND OF INVENTION

1. Field of the Invention

The invention relates generally to electrical connectors, and particularly to an electrical connector with a locking mechanism that assures a combination with a mating electrical connector.

2. Background Art

An electrical connector is a core component used in many electronic systems to connect wiring harnesses. In recent years, electronic systems have grown increasingly complicated. As a consequence, the number of electrical connectors used in some electronic systems has increased, along with the number of wiring harnesses. Some relatively large connectors have also been developed, which may be provided with several dozen terminals or poles. Such connectors may typically include sub housings or sub connectors corresponding to terminals of various types, such as optical fibers and electrical wires for communication and for power.

Connectors are typically manufactured by a connector manufacturer, and thereafter supplied to a harness assembler to attach wiring harnesses thereinto. For example, in the process of assembling a female connector, the terminals disposed at each end of the wiring harnesses may be inserted into a housing from a rear side of the housing. The female connector is typically provided with detents, which may be referred to as housing lances or terminal lances, within the housing thereof. When the terminals of the wiring harnesses are inserted into the housing, a portion of the detents may be moved upward due to interference with the terminals, and the lances may thereafter "snap" back to engage with notches of the terminals. The TPA (Terminal Position Assurance) member is then inserted into the housing, and bridges a gap in the housing to restrain undesirable movement of the detents. As shown by an exemplary connector, the TPA member is inserted into the housing from a front side surface of the housing, and thereby the TPA member bridges the gap, restraining the movement of the detents. The resulting female connector, as a final product, can be combined with a mating connector, i.e., a male connector. The larger connectors typically require a greater force to combine with the mating connector. Accordingly, the larger connectors are generally provided with an insertion-assist mechanism, such as a lever mechanism, in order to reduce an necessary insertion force. The insertion-assist mechanism may typically include a connector locking mechanism to assure a reliable connection between combined connectors.

SUMMARY OF INVENTION

In one aspect of the invention, an electrical connector includes a housing and a lever supported pivotally on a pivot disposed on the housing. The lever is configured to rotate on the pivot within a range from a pre-engagement position to a final engagement position. The lever includes a recess configured to accommodate a boss disposed on a mating connector therein in accordance with rotational movement of the lever. The lever also includes a locking mechanism having a detent to engage with an engaging portion disposed on the housing at the final engagement position. Further, the housing includes a movable stopper disposed on a surface thereof. The movable stopper engages with an edge portion of the lever at the pre-engagement position. When combined with the mating connector, the movable stopper primarily interferes with the boss, and is displaced so as to release the engagement with the edge portion of the lever. Thus, the engagement with the edge portion is released, and thereby the lever freely rotates on the pivot, while the boss is being fitted into the recess.

Other aspects and advantages of the invention will be apparent from the following description and the appended claims.

DETAILED DESCRIPTION

The invention is described below with reference to an exemplary embodiment illustrated in the attached drawings and made in accordance with a corresponding exemplary method.

Figure 1:
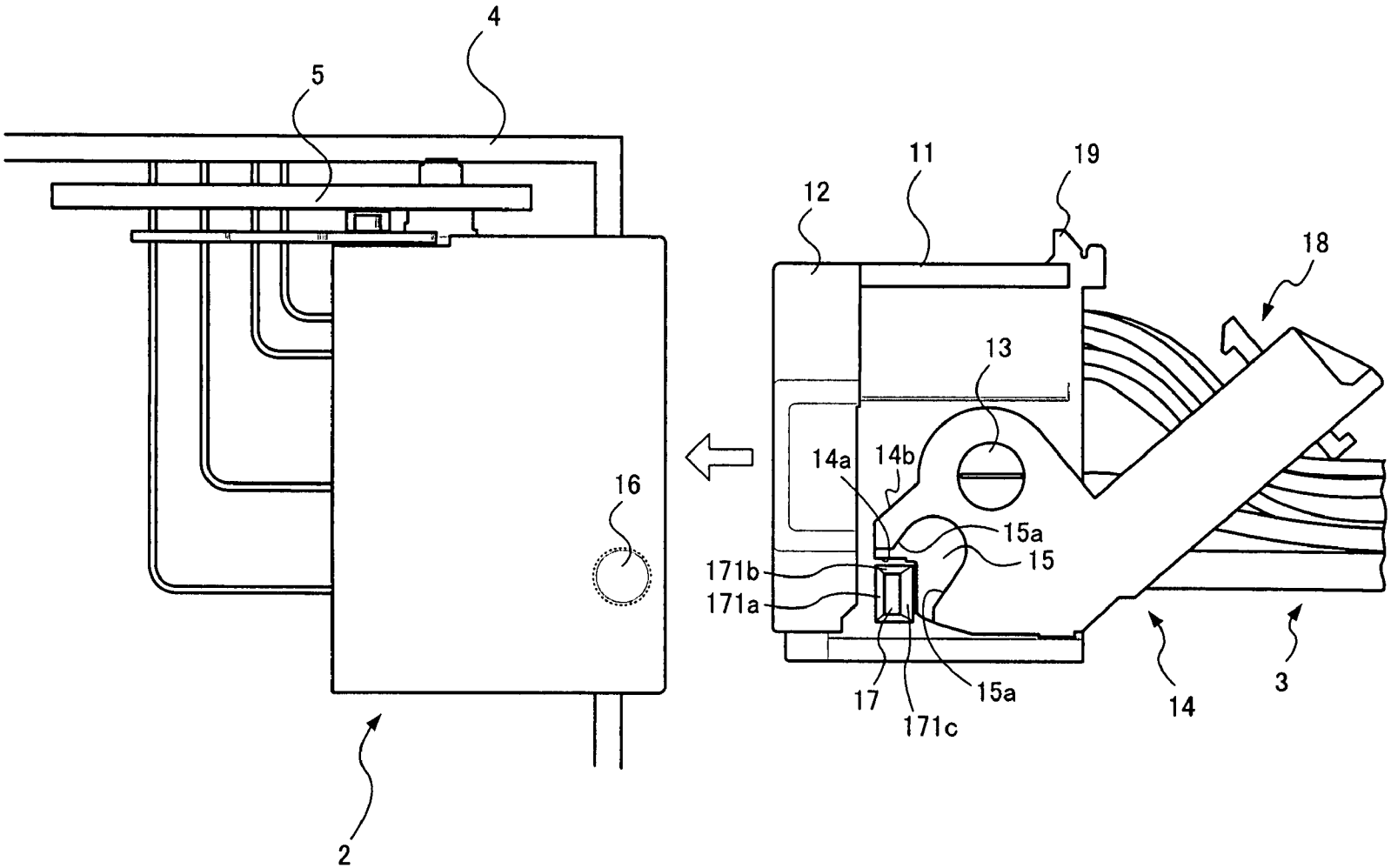
FIG. 1 illustrates an electrical connector, having a lever-typed connector locking mechanism, as it is about to be combined with a mating connector.

FIG. 1 illustrates a connector 1 according to one embodiment of the invention, as it is about to be combined with a mating connector 2. The connector 1 is of a female type. The female connector 1 is provided with a lever-typed-insertion-assist mechanism, and wiring harnesses 3 attaching themselves to the connector 1. The connector 2 is of a male type. The male connector 2 is mounted on a printed circuit board 5 disposed in a casing 4. The connector 1 to which wiring harnesses 3 is attached is supposed to combine with the connector 2 mounted on the printed circuit board 5, thereby resulting in electrical interconnection of terminals. The dimensions of the connector 1 are determined to a large extent by the size and number of the terminals.

Still referring to FIG. 1, the female connector 1 is shown as including a housing 11. A Terminal Position Assurance (TPA) member 12 is disposed at a front surface of the housing 11. The housing 11 includes cylindrical protrusions 13 disposed on both side surfaces thereof, and a roughly inverted U-shaped lever 14 is pivotally supported by the protrusions 13 (also shown in FIG. 2). The lever 14 includes an arcuate recess 16 configured to fit about a cylindrical boss 15 disposed on an inner surface of a housing of the male connector 2. The housing also includes a movable stopper 17 with chamfered corners. In this embodiment, the movable stopper is configured to have a tapered portion 171 composed of a tapered surface 171*a*, 171*b*, and 171*c*. The movable stopper 17 is disposed on a side surface thereof and configured to engage with an edge portion 14*a* of the lever 14 at a pre-engagement position as shown in FIG. 1.

In combining the mating connectors 1 and 2, the boss 16 comes into contact with the taper portion 171 of the movable stopper 17. The boss 16 moves the movable stopper 17 on the inward side of the housing 11, thereby allowing the engagement of the movable stopper 17 with the edge portion 14*a* of the lever 14 to be released, and then comes into contact with a guide portion 15*a* of the recess 15. Subsequently, by way of rotation of the lever 14 in a direction of an arrow A, the boss 16 is completely fitted into the recess 16 so as to combine the female connector 1 with the male connector 2.

The lever 14 also includes a connector locking portion 18. The connector locking portion 18 engages with a engaging portion 19 disposed on a corresponding portion of the housing 11 when the lever 14 is at a final engagement position, thereby restraining the rotational movement of the lever 14. Thus, the fit of the boss 16 into the recess 15 is maintained, and, as a consequence, the connection between the mating connectors 1 and 2 is assured.

Figure 2:
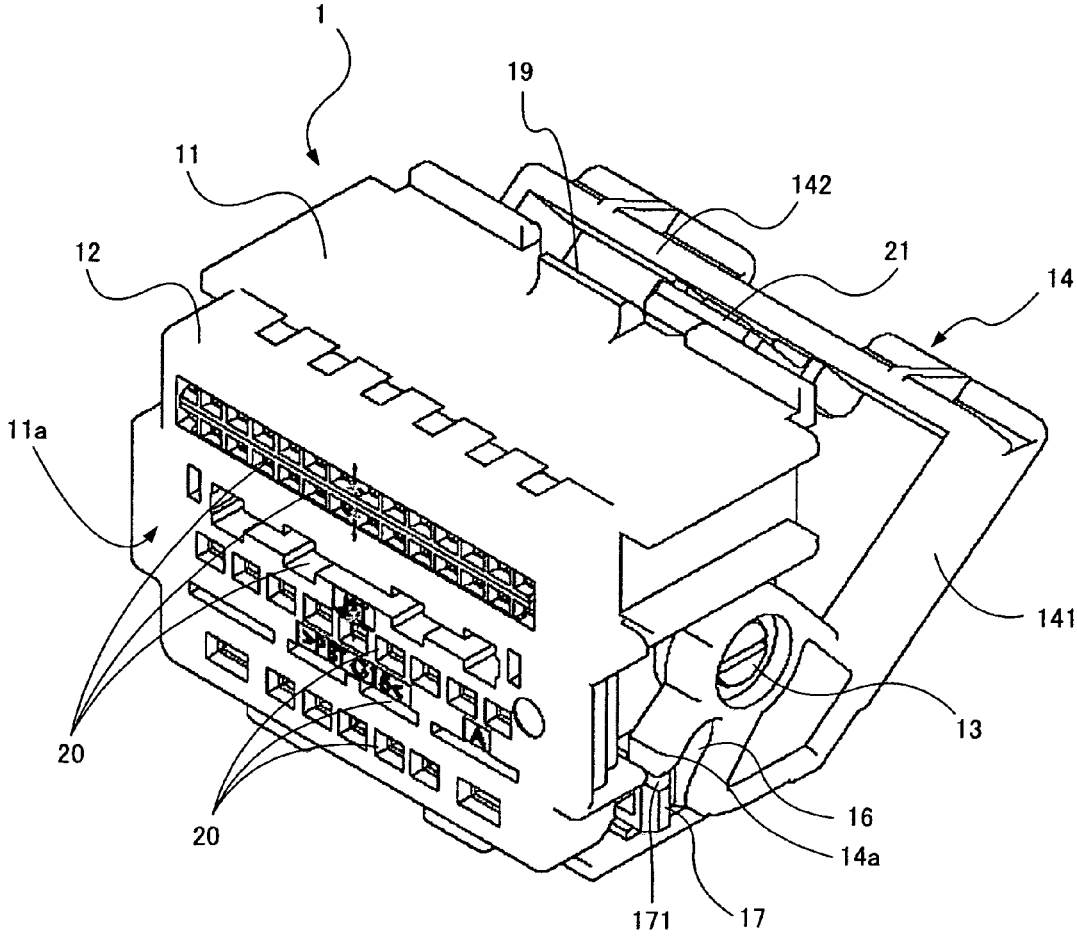
FIG. 2 illustrates a perspective view of an electrical connector with a lever when the lever is positioned at a pre-engagement position according to an embodiment of the invention.
Figure 3:
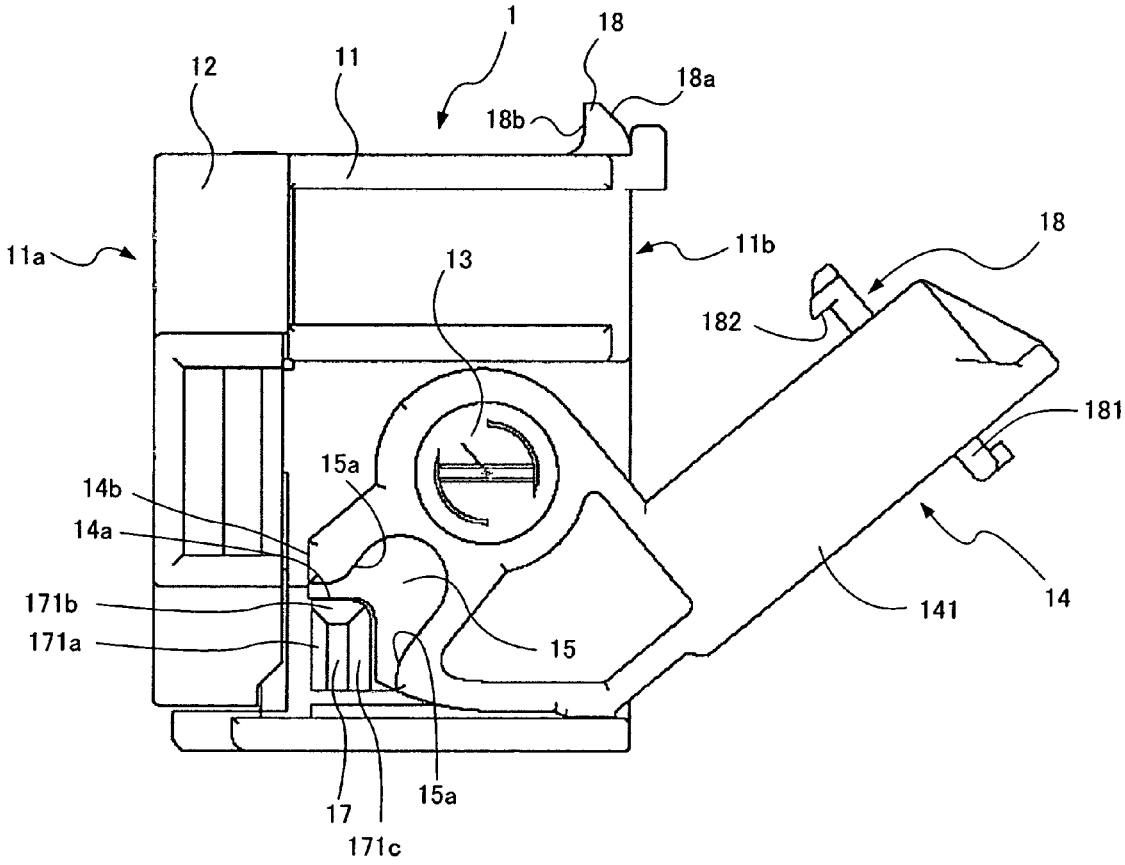
FIG. 3 illustrates a right side view of the connector show in FIG. 2.
Figure 4:
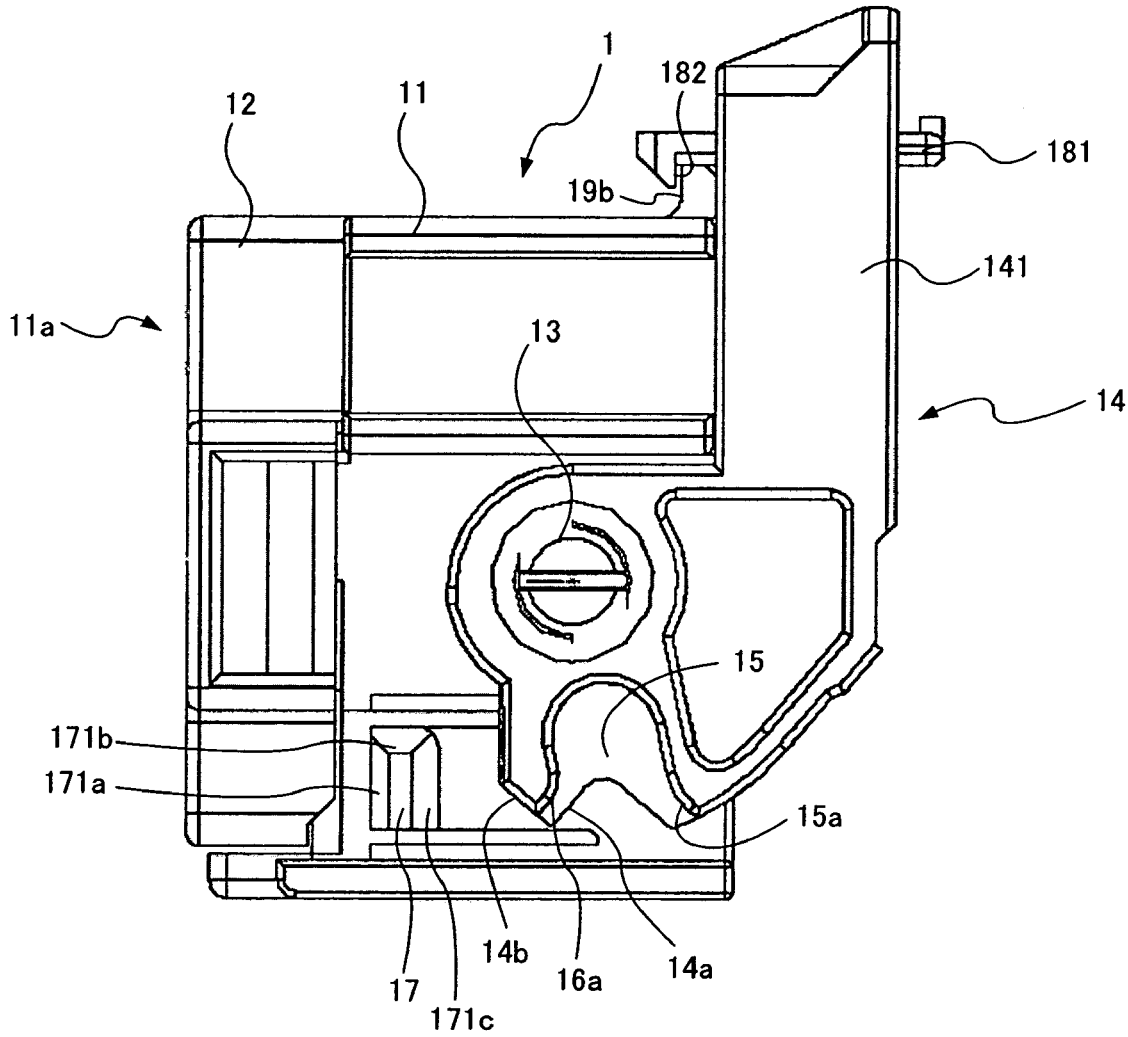
FIG. 4 illustrates a right side view of the connector when the lever is positioned at a final engagement position according to an embodiment of the invention.

FIGS. 2 through 4 illustrate the connector in detail according to an embodiment of the invention. The housing 11 is a single-piece component made of insulating material, such as plastic, using a molding method. The housing 11 may alternatively be formed using other known materials and methods. Referring now to FIGS. 2 and 3, the housing 11 has a front receiving portion 11*a* at a front surface thereof, and a rear receiving portion 11*b* at a rear surface thereof. The front receiving portion 11*a* receives the TPA member 12 therein, and a plurality of front terminal slots 20 corresponding to the number of the terminals is configured accordingly. The TPA member 12 assures a proper position of the terminals of wiring harnesses 3 as described above. The plurality of front terminal slots 20 on the front receiving portion 11*a* of the housing 11 are linked to a plurality of rear terminal slots on the rear receiving portion 11*b* through passageways within the housing 11 (not shown). The terminals disposed at ends of the wiring harnesses 3 are inserted in the rear terminal slots designed on the rear receiving portion 11*b* of the housing 11, while the TPA member 12 is fitted into the front receiving portion 11*a* of the housing, and whereby a female connector as a final product is configured. It is noted that FIG. 2 shows the configuration of the female connector 1 to which the TPA member 12 is already attached before inserting the wiring harnesses into the housing 11. Depending on a type of the connector 1, it is known that the connector 1 may be configured to accommodate the TPA member 12 from a side or bottom surface thereof.

As described above, the housing 11 is provided with the lever 14, which also serves as the connector locking mechanism. In this embodiment, the lever 14 is formed in a roughly inverted U-shape such that a beam 142 extending laterally is supported by two arms 141 at both side ends thereof. A pair of pivotal protrusions 13 formed in a cylindrical shape is disposed on both sides of the housing 11. The two arms 141 are supported pivotally on the protrusions 13, and thereby the lever 14 is configured to move rotationally on the protrusions 13. The connector locking portion 18 is disposed in proximity of the middle of the beam 142. The connector locking portion 18 includes a flap portion 181 suspended from the beam 142, and a detent portion 182 disposed on a free end of the flap portion 181. The engaging portion 19 is disposed on a top, rear portion of the housing 11 so as to correspond with the detent portion 182. In accordance with the rotational movement of the lever 14, the detent portion 182, which is approaching the engaging portion 18 of the housing 11, is moved upward due to interference with a tapered portion 19*a*. Thereafter, the detent portion 182 snaps back to engage with an engaging surface 19*b*. As a consequence of this, the rotating movement of the lever 14 is restrained at the final engagement position as shown in FIG. 4.

As shown in FIG. 3, the movable stopper 17 is disposed on one side surface of the housing 11. The movable stopper 17 includes the tapered portion 171. The movable stopper 17 now engages with the edge portion 14*a* of the lever 14 at the pre-engagement position. The movable stoppers 17 may be disposed on both sides of the housing 11. The movable stopper 17 is configured to be displaced on the inward side of the housing 11 by an external force applied thereto.

Figure 5:
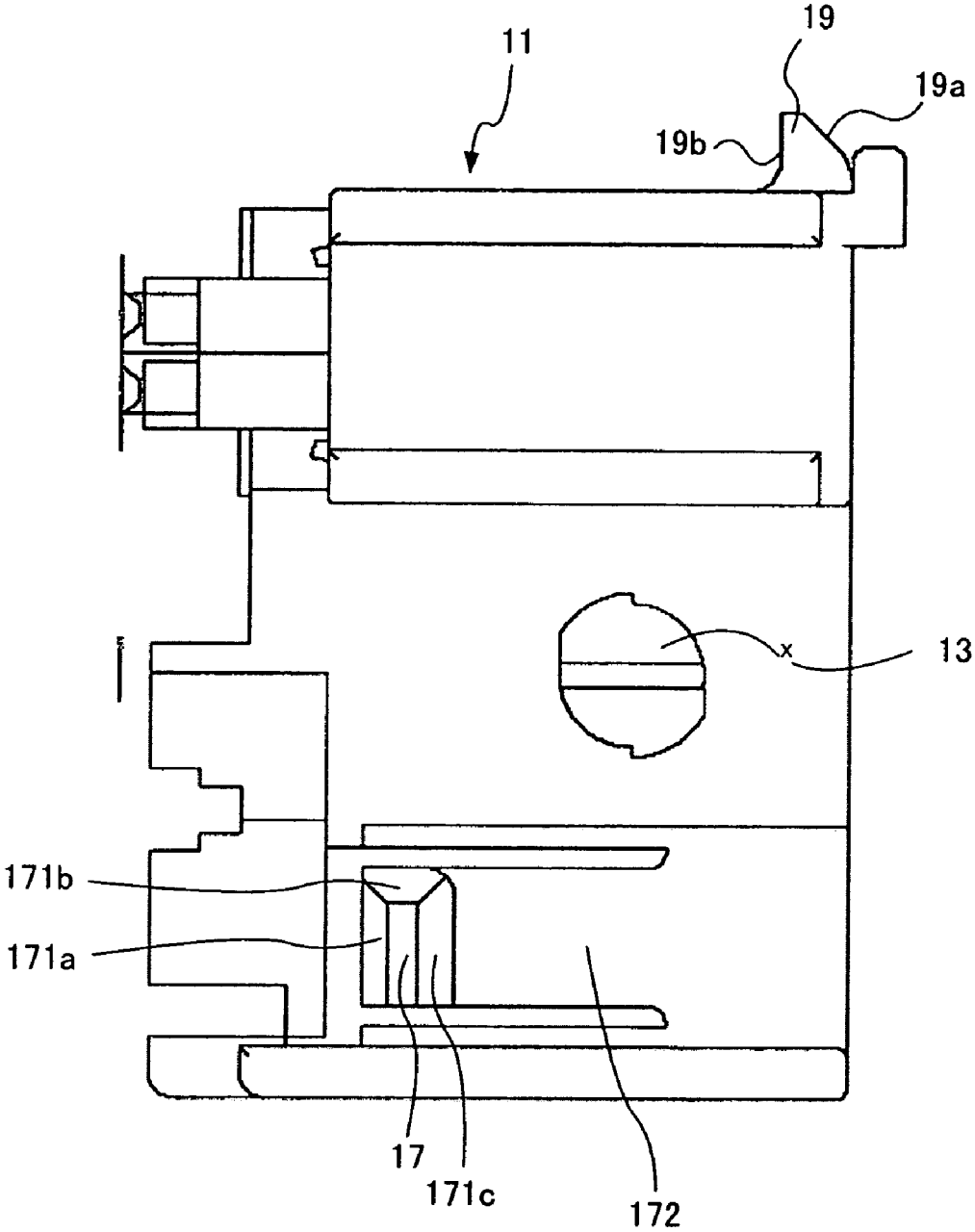
FIG. 5 illustrates a right side view of the housing of the connector shown in FIG. 2.
Figure 6:
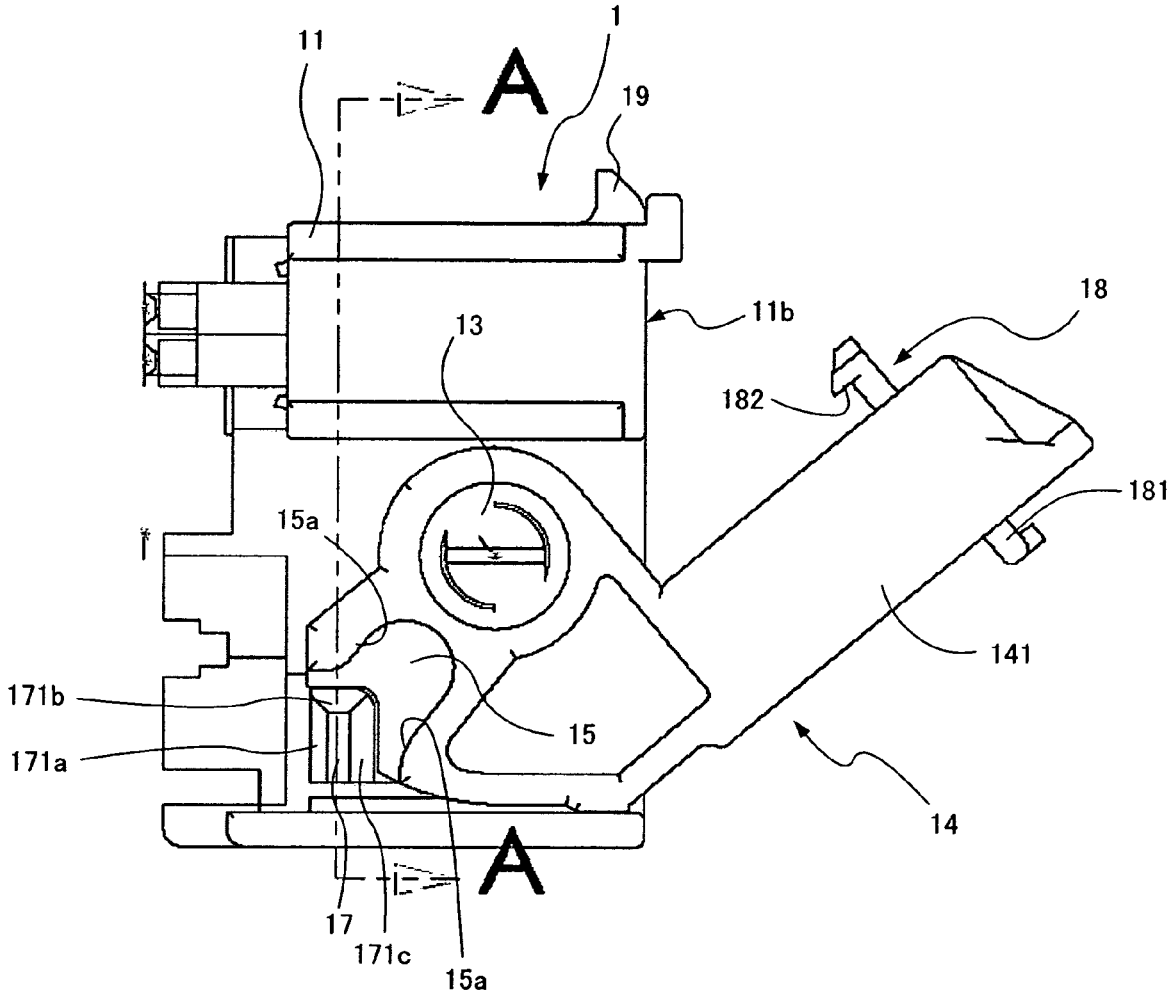
FIG. 6 illustrates a right side view of the housing with the lever of the connector shown in FIG. 2.
Figure 7:
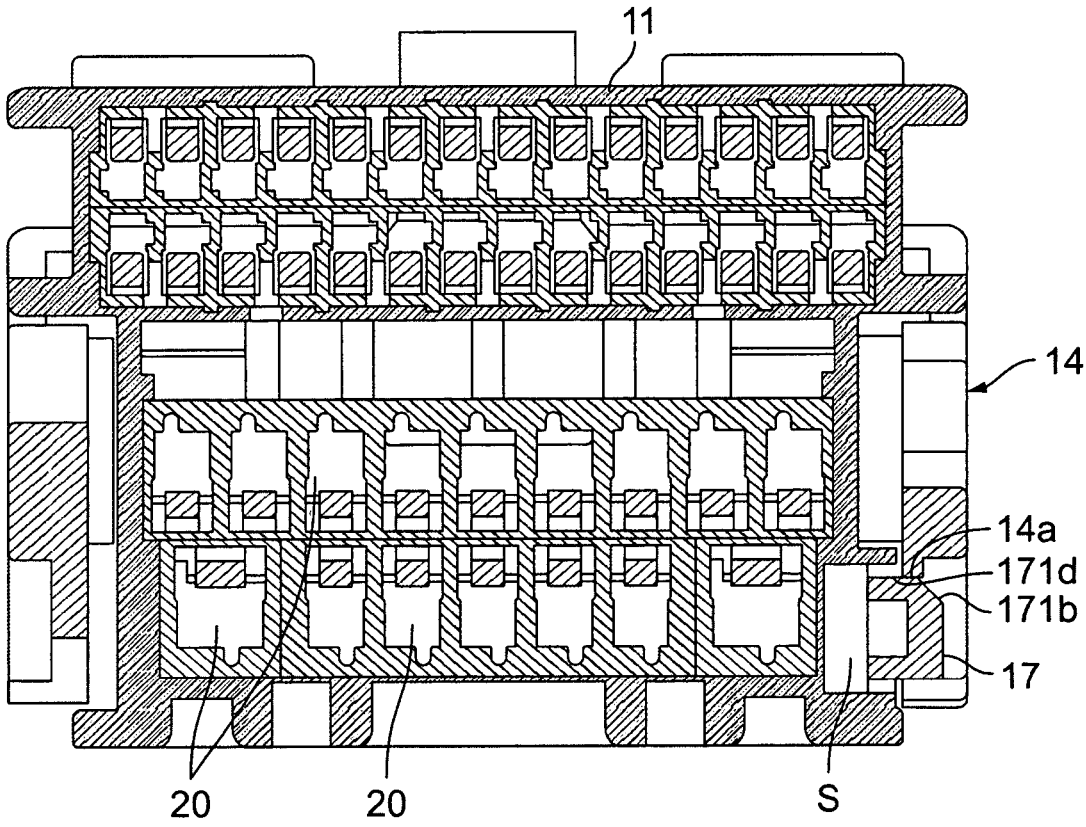
FIG. 7 illustrates a cross-sectional view of the housing with the lever along the A—A line of FIG. 6.

The movable stopper 17 will be discussed in detail below. FIG. 5 illustrates a right side view of the housing 11, and FIG. 6 illustrates a right side view of a configuration of the housing 11 attached the lever 14. Further, FIG. 7 illustrates a cross-sectional view of the housing 11 with the lever 14 along the A—A line shown in FIG. 6.

Referring to FIG. 5, the movable stopper 17 integrally formed with the housing 11 includes the tapered portion having at least the tapered surface 171*a*, 171*b*, and 171*c*. The tapered portion contributes to displacement of the movable stopper 17 in an inward direction by an external force applied thereto. An interference portion with the movable stopper 17 (i.e., the edge portions 14*a* and 14*b* and/or the boss 16) may be alternatively chamfered or rounded. The movable stopper 17 is elastically supported by a cantilever-like beam 172 extending from a rear portion of the housing 11 so as to move on the inward side of the housing 11. Specifically, as shown in FIG. 7, a space S is formed between the movable stopper 17 and the housing 11, thereby the movable stopper 17 is accommodated into the space S by an external force applied thereto.

Figure 8:
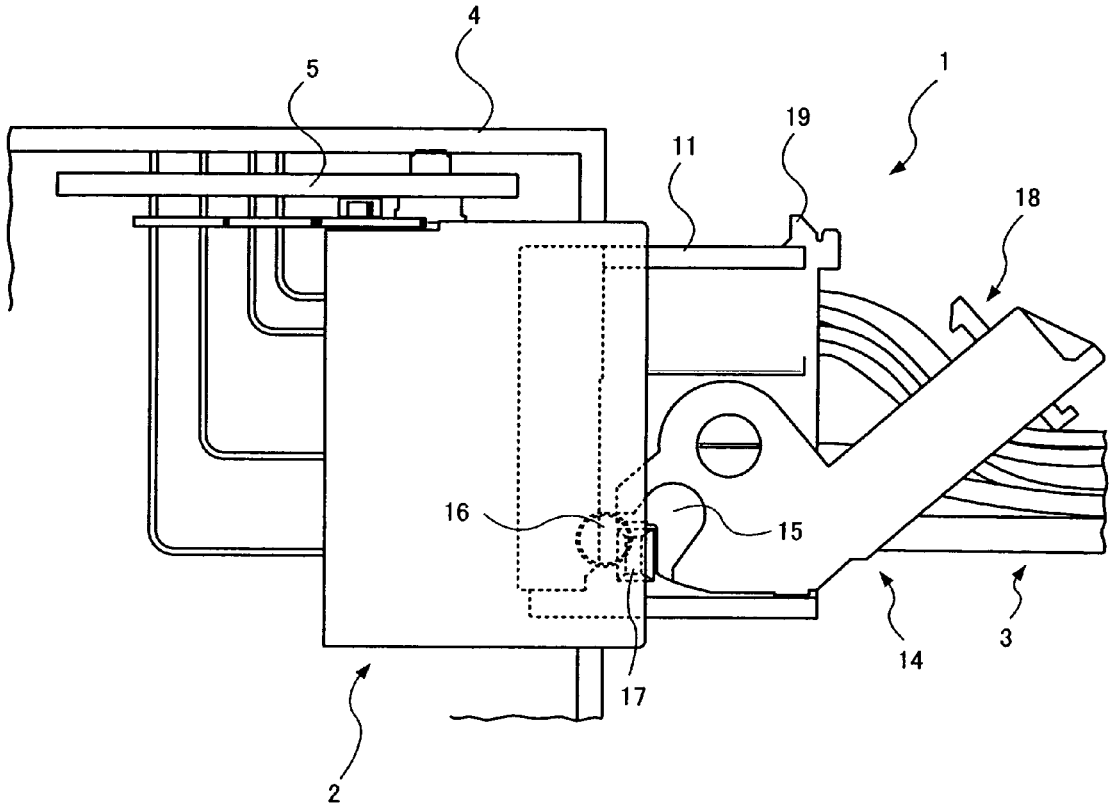
FIG. 8 illustrates the electrical connector shown in FIG. 1, as it is about to be combined with a mating connector.

Referring to FIG. 6, a position of the movable stopper 17 is selected so as to disposed in proximity of an opening of the recess 15 of the lever 14 that is positioned at the pre-engagement position. When the lever 14 is positioned at the pre-engagement position, the lever 14 is engaged with a horizontal surface 171*d* of the movable stopper 17 (FIG. 7). Referring now to FIG. 8, in combining the connectors 1 and 2, the boss 16 of the connector 2 primarily comes into interference with the tapered surface 171*a* of the movable stopper 17, and thereby its reactive force takes place so as to displace the movable stopper 17 in a direction transverse (i.e., an inward direction) of the housing 11. As a consequence, the movable stopper 17 is pushed into the space S slightly.

When the movable stopper 17 flees to the space S due to the interference with the boss 16, the tapered surface 171*b* of the movable stopper 17 is subject to interference with the edge portion 14*a* of the lever 14. Thus, in accordance with the rotational movement of the lever 14, its reactive force takes place so as to further displace the movable stopper 17 in the transverse direction. Accordingly, the movable stopper 17 is completely pushed into the space S, thereby allowing the lever 14 to be freely rotated. The further rotational movement of the lever 14 frees the movable stopper 17 that is displaced in the space S from the interference with the lever 14, and accordingly the movable stopper 17 backs to the initial position. When the lever 14 is positioned at the final engagement position, the lever 14 is simply locked by the engagement of the locking portion 18 with the engaging portion 19, but not may be engaged with the movable stopper 17. In contrast to the rotational movement as discussed above, when the lever 14 is rotated from the final engagement position to the pre-engagement position, an external edge portion 14*b* of the lever 14 comes into interference with the tapered surface 171*c* of the movable stopper 17. Thus, the movable stopper 17 is pushed into the space S, and thereafter backs to the initial position, restraining the lever 14.

As a result of various configurations described in detail above, embodiments of the invention may include one or more following advantages, some of which have been discussed above. According to one embodiment of the invention, for example, an female connector includes a stopper to temporally fix a lever at a pre-engagement position. Thus, wobble of the lever in conveyance of the connector can be restrained, thereby preventing the lever from damage. Further, an user or assembler can easily verify whether the lever is properly positioned at the pre-engagement position, thereby enhancing the efficiency of assembly.

Further, according to one embodiment of the invention, a connector with a lever is configured such that, in accordance with rotational movement of the lever, a stopper comes into interference with the lever and thereby is moved on the inward side of the connector. Thus, efficiency in combining mating connectors is enhanced.

Furthermore, according to one embodiment of the invention, a connector with lever is configured such that a stopper is primary moved due to interference with a boss disposed on a mating connector. Thus, engagement of the stopper with the lever is released only when combining the connectors. Accordingly, efficiency in combining the connector and the mating connector is enhanced. Further, because of operation of the boss, which is originally disposed for an insertion-assist mechanism, no additional mechanism needs to be disposed on the mating connector. Accordingly, not only the mating connector but the connector can be downsized and simplified.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector comprising:

a housing;

at least one pivot disposed on the housing;

a lever configured to rotate on the pivot within a range from a first position to a second position, wherein the lever has a recess configured to fit a boss disposed on a mating connector therein in accordance with rotational movement of the lever; and a movable protrusion disposed on the housing in proximity of a gateway of the recess of the lever at the first position and configured to engage with an edge portion of the gateway of the recess of the lever at the first position, wherein the movable protrusion is displaced so as to release the engagement with the lever by an external force applied thereto.

2. The connector according to claim 1, wherein the movable protrusion is elastically supported by a cantilever beam extending from a surface of the housing.

3. The connector according to claim 2, wherein a space is formed between the movable protrusion and the surface of the housing, wherein the movable protrusion is accommodated within the space.

4. The connector according to claim 1, wherein the movable protrusion has an engaging surface configured to engage with the edge portion of the lever at the first position.

5. The connector according to claim 1, wherein the movable protrusion has at least one tapered surface.

6. A connector comprising:

a housing;

at least one pivot disposed on the housing;

a lever configured to rotate on the pivot within a range from a first position to a second position, wherein the lever has a recess configured to fit a boss disposed on a mating connector therein in accordance with rotational movement of the lever; and a movable protrusion disposed on the housing and configured to engage with an edge portion of the lever at the first position, wherein a first tapered surface of the movable protrusion comes into interference with the boss of the mating connector, whereby the movable protrusion is displaced, and the engagement of an engaging surface of the movable protrusion with the edge portion is released.

7. The connector according to claim 6, wherein a second tapered surface of the movable protrusion comes into interference with the edge portion of the lever, whereby the movable protrusion is displaced to allow the lever to freely rotate on the pivot.

8. A connector set comprising:

a first connector, wherein the first connector comprises:

a first housing; and a boss disposed on the first housing; and a second connector, wherein the second connector comprises:

a second housing;

at least one pivot disposed on the housing;

a lever configured to rotate on the pivot within a range from a first position to a second position, wherein the lever has a recess configured to fit the boss of the first connector therein in accordance with rotational movement of the lever;

a movable protrusion disposed on the second housing in proximity of a gateway of the recess of the lever at the first position and configured to engage with an edge portion of the gateway of the recess of the lever at the first position, wherein the movable protrusion is displaced so as to release the engagement with the lever by an external force applied thereto.

* * * * *

UNITED STATES PATENT AND TRADEMARK OFFICE

CERTIFICATE OF CORRECTION

PATENT NO. : 7,090,518 B1
APPLICATION NO. : 11/130498
DATED : August 15, 2006
INVENTOR(S) : Tsuyoshi Osada et al.

It is certified that error appears in the above-identified patent and that said Letters Patent is hereby corrected as shown below:

In the Specification:

At column 2, line number 59, “16” should read –15–.

At column 2, line number 60, “15” should read –16–.

At column 3, line number 10, “16” should read –15–.

Signed and Sealed this
Sixteenth Day of February, 2016

Michelle K. Lee

Michelle K. Lee
*Director of the United States Patent and Trademark Office*